US005211621A

United States Patent [19]

Cheynet

[11] Patent Number: 5,211,621

[45] Date of Patent: May 18, 1993

[54] DEVICE FOR ZIGZAG FOLDING OF A COUNTINUOUS TAPE

[75] Inventor: Rene Cheynet, Saint-Just-Malmont, France

[73] Assignee: ETS J. Cheynet et Ses Fils, France

[21] Appl. No.: 761,963

[22] PCT Filed: Feb. 1, 1991

[86] PCT No.: PCT/FR91/00063

§ 371 Date: Nov. 19, 1991

§ 102(e) Date: Nov. 19, 1991

[87] PCT Pub. No.: WO91/12194

PCT Pub. Date: Aug. 22, 1991

[30] Foreign Application Priority Data

Feb. 8, 1990 [FR] France ..... 90 01847

[51] Int. Cl.[5] ..... B65H 45/103

[52] U.S. Cl. ..... 493/413; 493/423

[58] Field of Search ..... 493/411, 412, 413, 414, 493/415, 423, 424

[56] References Cited

U.S. PATENT DOCUMENTS 4,493,689 1/1985 Affupper ..... 493/415

4,670,001 6/1987 Campbell et al. ..... 493/413

FOREIGN PATENT DOCUMENTS 0062753 10/1982 European Pat. Off. .

0360712 3/1990 European Pat. Off. .

1141610 12/1962 Fed. Rep. of Germany ..... 493/411

2636614 3/1990 France .

*Primary Examiner*—William E. Terrell

*Attorney, Agent, or Firm*—Eckert Seamans Cherin & Mellott

[57] ABSTRACT

A device for the zigzag folding of flexible tapes is mounted on an entablature. The entablature includes a guide for distributing the tape. A pair of rollers are disposed within a transverse slot on the entablature. The rollers are each provided with an alternating succession of disks and pulleys. The disks are fixed to said rollers so as to rotate together. Each of the pulleys accepts a cable. The plurality of cables constitutes a belt for aiding in advancement of the tape. The rollers are coupled to a support carriage including a motor for rotating the rollers in opposite directions, the tape being guided between the oppositely rotating rollers and disks.

12 Claims, 4 Drawing Sheets

DEVICE FOR ZIGZAG FOLDING OF A COUNTINUOUS TAPE

The invention pertains to the technical field of machines and materials for the packaging of flexible tapes made of textile material such as ribbons and similar products.

It is first of all stated that textile tapes and ribbons are packaged in packing material and presented with a zigzag alternation.

In order to accomplish this, a device is provided which comprises an entablature with a rear zone receiving means for the distribution of the fabricated tape, a central zone equipped with a transverse slot allowing the alternating displacement of a pair of rollers between which is guided the tape, the rollers being mounted on a carriage driven by control means in an alternating transverse movement in relation to the aforementioned slot and allowing at the outlet of the rollers the folding of the tape, with the aforementioned entablature having a front zone allowing the reception and discharge of the parts of the continuous folded tape and their discharge to the packaging zone. There are also provided means for the advancement of the folded tape or ribbon parts.

In a specific implementation, the applicant for the present patent proposed an improved device comprising two specific features defined in French Patent No. 88.12709.

The first specific feature is comprised of making each of the rollers alternatively positive with respect to the direction of tape advance irrespective of the direction of displacement of the carriage. For this purpose, the rollers are driven by free wheels mounted in opposition.

The second specific feature is comprised of acting by means against the strands of the part of the tape in relation to the outlet of the pair of rollers by assuring an alternating application and release of pressure of each of the half-parts of the tapes that has been executed so as to maintain the parts of the folded tapes in the vertical position. The aforementioned means are of the belt type.

In the context of exploiting the aforementioned patent which was completely satisfactory for the majority of tapes and ribbons processed, it was found that certain types of ribbons had a tendency to unfold. This problem occurred with ribbons with a certain "nervousness", i.e., a tendency to slacken and thereby constitute an impedimentation of packing. Thus, it was necessary to improve the device so as to make it capable of handling this problem.

In addition, in the state of conception of the rollers, the devices employed exhibited certain limits under the conditions of processing tapes or ribbons with a limited width.

Thus, a first goal of the invention was to improve the existing devices so as to allow quick adjustment of the rollers irrespective of the width dimensions of the tapes or ribbons.

Another goal of the invention was to be able to employ the device for the zigzag folding of tapes or ribbons irrespective of their composition or application.

Another goal of the invention was to improve the existing devices by the use of supplementary modular means that could be assembled and disassembled quickly with a very large capacity of adjustment in fulfilling the performance conditions for tapes or ribbons so as to achieve perfect packaging.

These goals as well as other goals will become evident from the description below.

In accordance with a first characteristic, the device is noteworthy in that it comprises an entablature with a rear zone and means for distribution of the fabricated tape, a central zone fitted with a transverse slot allowing the alternating movement of a pair of rollers between which is guided the tape, the said rollers being mounted on a carriage driven by control means in an alternating transverse movement in relation to the aforementioned slot and thereby allowing the discharge from the rollers of the fold of a ribbon, and a front zone allowing the reception and discharge of the parts of the continuously folded ribbon and their discharge towards the packaging zone, with this device also having means for advancing the folded ribbon parts in the form of belts; with the device being characterized in that the rollers are mounted on joining and guiding spindles the lower ends of which are attached to a support structure associated with the carriage, said rollers consisting of an alternating succession of modular sets of disks and pulleys taking cables, a multiplicity of cables defining one or several belts for advancing parts of the tapes and ribbons, a first end of the cables being secured on fixing means offset at an angle to the plane of the rollers, said cables being parallel and horizontal, the number of disks and pulleys varying according to the width of the type or ribbon to be folded, each pulley being mounted free to rotate independently of the direction of rotation of the rollers.

In accordance with another characteristic, the device is noteworthy in that each disk has on its periphery a crown made of flexible material, the unit of installed disks and crowns defining a common vertical generatrix, and in that the said pulleys have smaller diameters than the associated disk and crown, the cables being situated in the interior space of each roller, and in that the rollers are thereby mounted so as to allow passage only of the tape or ribbon to be folded.

In accordance with another characteristic, the device is noteworthy in that the joining and guiding spindles are equipped at their base with a lower shoulder allowing the centering and support of the successive elements constituting each roller.

These characteristics and additional characteristics will become clear from the description below.

In the drawings, which illustrate the invention in a nonlimitative manner:

Figure 1:
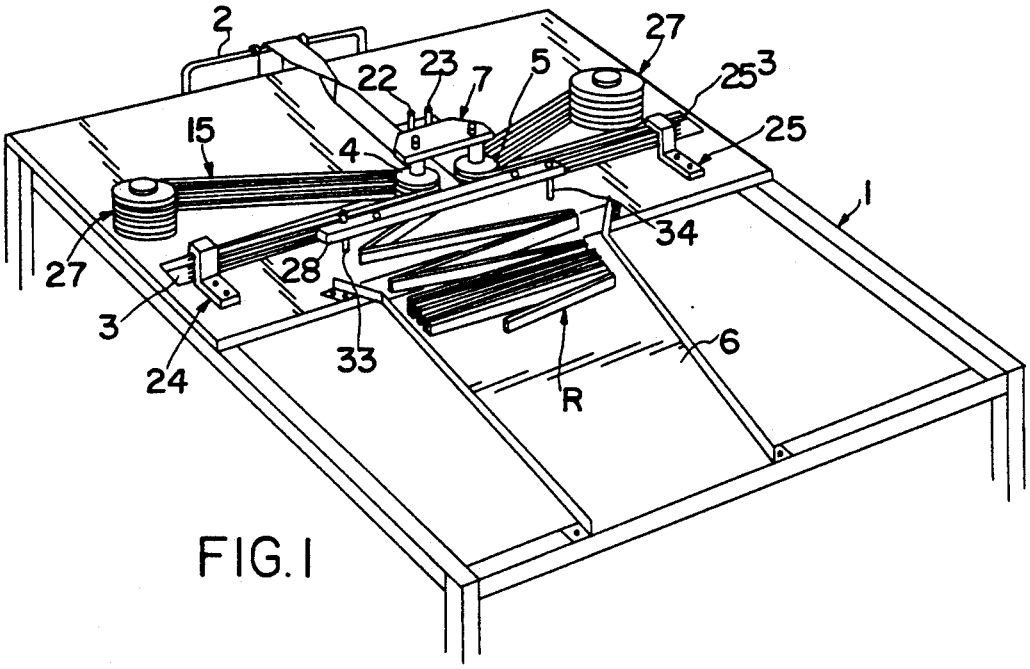
FIG. 1 is a perspective view showing the device in accordance with the invention positioned on an entablature.
Figure 2:
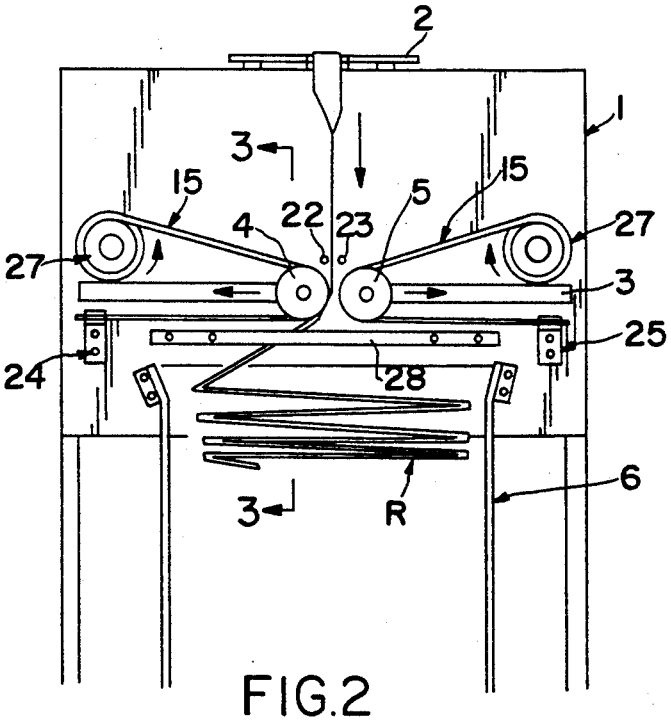
FIG. 2 is a top view of FIG. 1.

In order to render the object of the invention more concrete, it will now be described in a nonlimitative manner illustrated in the drawings.

The device in accordance with the invention provides for the zigzag folding of flexible tapes notably made of textile material and of ribbons in particular, in accordance with automatic continuous processing. The device is positioned in a known manner on an entablature (1) which has successively a zone and means (2) for distribution of the tape or ribbon originating from a roll on which the tape was wound during fabrication or loose, depending on the prior fabrication procedures. The means (2) comprises in a nonlimitative manner a guide for transmitting and presenting the tape to the tape routing rollers (4) and (5).

The central or essentially central part of the entablature is equipped with a transverse slot (3) allowing the alternating movement of a pair of rollers (4) and (5) mounted so as to rotate in opposite directions and between which is guided the end of the tape or ribbon R which is then folded in a zigzag manner.

The motor means permitting the transverse movement of the support carriage (7) of the pair of rollers (4 and 5) are situated in the bottom part of the entablature and protected by protective plates, whereas the rollers are in the top plane of the entablature.

Figure 3:
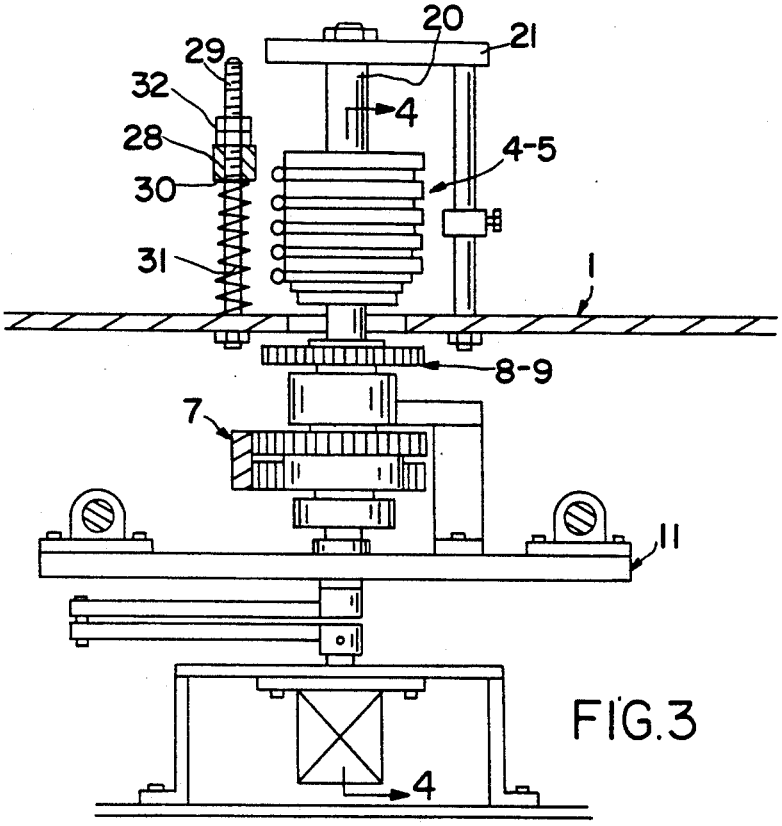
FIG. 3 is a longitudinal sectional view along line 3—3 of FIG. 2.

So as to assure the said movement, the carriage is associated at its bottom part with suitable known control means which could, for example, nonlimitatively consist of a system of connecting rods or cranks controlled by a motor, assuring the aforementioned back and forth movement, as shown schematically in FIG. 3; these means were described in the previously cited French patent.

The amplitude of the displacement of the carriage is adjustable in a known manner and varies according to the desired length of the folds of the tapes or ribbons.

Following an alternating movement of the support carriage, the folded tape is then routed onto the front part of the entablature, being guided longitudinally by bars (6) attached in any suitable manner. Thus, as the tape is folded, it is led towards the front of the entablature and falls into a package provided for this purpose and not illustrated.

The rollers (4) (5) are driven in a rotational movement which varies with the direction of displacement of the carriage. In a first nonlimitative specific implementation described in French Patent No. 88.12709, the rollers (4, 5) are made alternatively positive irrespective of the direction of displacement of the carriage. This is accomplished by means of free wheels (8, 9) associated with the assembly of the said rollers.

In addition and in a known manner, the device includes a belt which, during the folding of the tapes or ribbons, acts alternately according to the position of the carriage and thus of the rollers (4, 5) on the parts of the aforementioned tapes or ribbons. This action is comprised of the exertion of a temporary pressure and push against the folded part of the ribbon and accompanying the direction of advance of the carriage.

It is now appropriate to present the characteristics of the invention with reference to the FIGURES.

The device is first of all noteworthy because of the novel concept of the rollers (4 and 5) which can be driven positively by means of free wheels in accordance with Patent No. 88.12709 or in any other manner.

Thus, the rollers referenced as units by (4, 5) are mounted on joining and guiding spindles or shafts (10) the lower ends of which are attached by suitable means to the support structure (11) referenced as a unit and associated with the carriage (7). These joining means are, for example, those described in the previously cited French Patent or other types.

Figure 4:
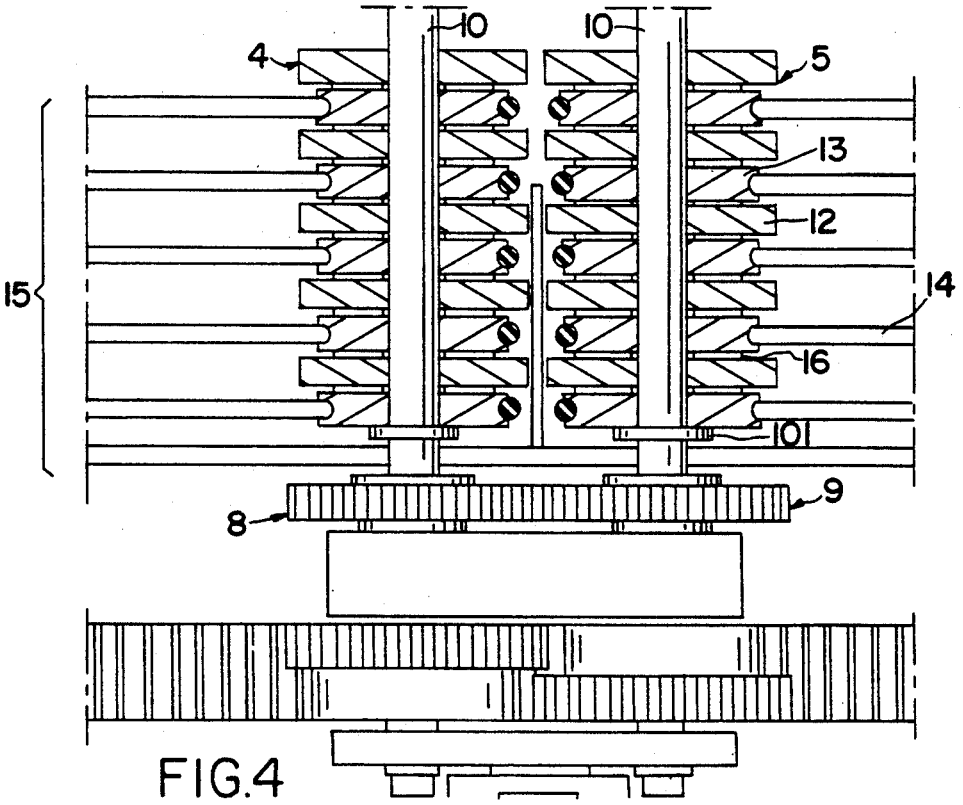
FIG. 4 is a view along line 4—4 of FIG. 3.

The originality of these rollers is that they are constituted of an alternating succession of disks (12) and of pulleys (13) taking cables (14), with a multiplicity of pulleys creating a multiplicity of cables (14), the totality of which constitutes the belt or belts (15) for advancing the parts of the tapes or ribbons. Thus, there is shown for example in FIG. 4, the joining spindles or shafts (10) which have a shoulder at their lower bottom base (10.1) which allows the centering and support of one of the constitutive elements of the rollers and, for example, a pulley.

Then, as if we were assembling a construction toy, the disks and pulleys are mounted in an alternating manner on the spindle with mechanical means of the washer (16) or equivalent type, so as to permit the independence of movement of the pulleys in relation to the disks. Thus, as is shown in the drawings, the disks have at their periphery a crown (17) made of a flexible, adhesive material. All of the disks and associated crowns define a common vertical generatrix and when the two rollers (4, 5) are mounted in this manner, they only allow passage of the tape or ribbon which is drawn through by their rotational movement. The pulleys (13) have smaller diameters than the disks (12) and associated crowns such that the cables (14) are situated in the interior space of each roller.

Figure 11:
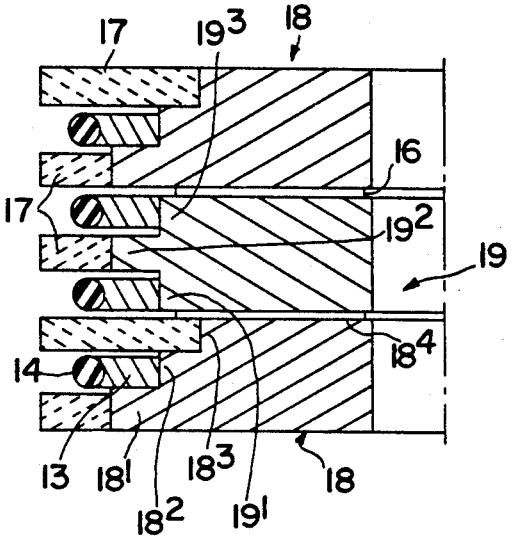
FIG. 11 is a partial view showing a possible nonlimitative mechanical assembly of the rollers.
Figure 5:
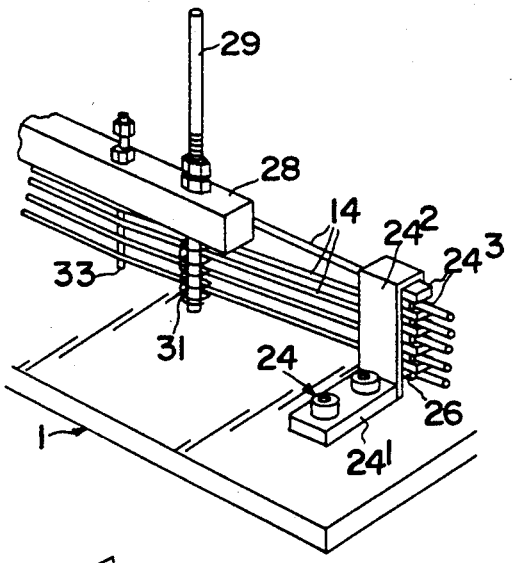
FIG. 5 is a partial sectional view illustrating the winding and attaching reel of the ribbon or tape pressing and advancement means.
Figure 6:
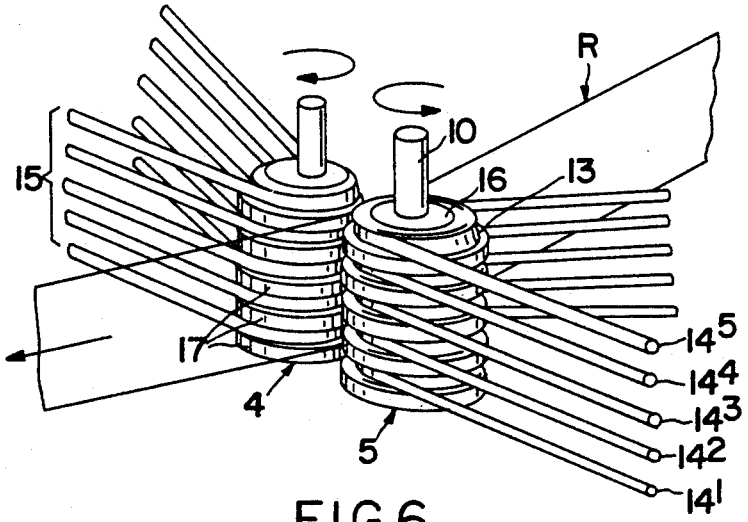
FIG. 6 is a partial large-scale perspective view illustrating the passage of the ribbon or tape between two driving rollers in accordance with the invention.
Figure 8:
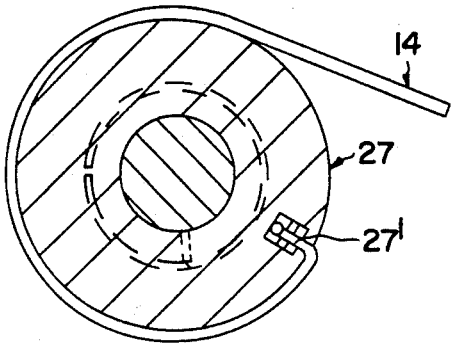
FIG. 8 is a partial sectional view of a reel.
Figure 7:
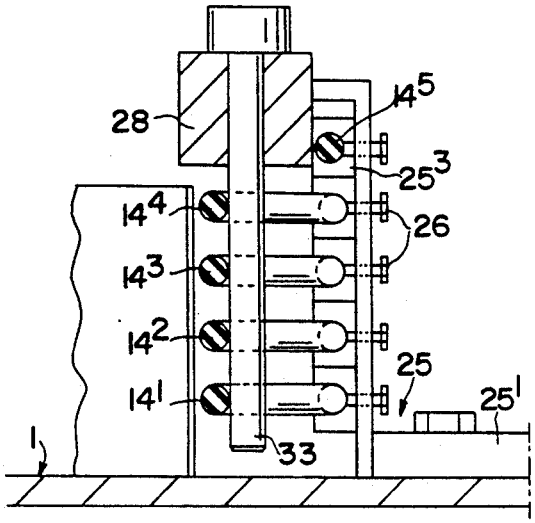
FIG. 7 is a partial large-scale perspective view illustrating the use of a specific means to facilitate the shaping and positioning of the ribbon or tape in preparation for packaging.

The mounting on the spindles (10) of the modular elements constituting the rollers can be effected by any known mechanical means while still preserving the same concept of realization. FIG. 11, for example, illustrates one possible implementation of the mounting. For example, two pairs of rings (18–19) are employed. They are mounted in an alternating manner on the joining spindles or shafts (10). These rings (18–19) are designed and equipped with shoulders so as to receive at least one crown (17) made of flexible material and at least one cable-driving pulley (13).

In the implementation illustrated nonlimitatively in FIG. 11, the first ring (18) has multiple staged parts (18.1–18.2–18.3–18.4) receiving respectively a first crown (17), a pulley (13), a second crown (17) then a spacing and support area for the second ring (19). This ring is designed and profiled with staged parts (19.1–19.2–19.3) so at to allow the successive positioning of a first pulley (13), a crown (17) and a second pulley (13). Each roller (4–5) is thereby constituted with the successive and alternating mounting of rings (18–19), the number of which varies according to the width of the ribbon driven. The pulleys are mounted in free rotation whereas the disks 12 and the associated rings (18) are driven according to the direction of rotation of the rollers (4–5) as a function of the position of the carriage. Each joining spindle or shaft (10) receives at its top end a bracing ring (20) on which is arranged and attached a horizontal profiled connecting plate (21) assuring the retention of the rollers (4, 5) and their attachment. The connecting plate (21) also receives in a rear plane two shafts (22-23) arranged vertically to allow the passage and guiding of the tape or ribbon for the purpose of its introduction between the rollers (4–5).

In close relationship with the aforementioned assembly of the rollers, one obtains a multiplicity of the strands of cables constituting and defining together the belt (15) for advancing the tape or ribbon. The various cables are wound on the pulleys in successive stages planes which are parallel and horizontal. Thus, one thereby obtains five strands (14.1–14.2–14.3–14.4–14.5) in the nonlimitative illustrated example. The ends of these strands are attached to fixing means (24–25) at successive heights to preserve their parallelism and horizontality. For this purpose, the fixing means (24–25) are positioned at the discharge side of the folded and packaged tape or ribbon, and are offset angularly frontward in relation to the external generative plane of the two rollers (4–5). The two fixing means (24–25) comprise an attachment base (24.1–25.1) on the entablature which is possibly adjustable in position so as to adapt to the degree of angularity of the belt parts in relation to needs. Each base (24.1–25.1) is extended vertically by a block in the form of a parallelepiped (24.2–25.2) or some other form, provided notably with a plurality of channels (24.3–25.3) allowing engagement of the cables. Means (26) are associated with each channel to grasp, retain and lock each cable in position and provide the cables with perfect positional performance. Each block can be provided with a large number of channels to correspond to the number of cable strands defining the advancing belt or belts as a function of the width of the ribbon or tape being processed.

The said cable strands can define in their continuity a single belt or two identical belts such as is shown in the drawings.

In the first possible implementation, which is not illustrated, the various cable strands that are guided by the rollers (4, 5) are oriented and pass around return bars positioned in the rear part of the entablature in the manner described in Patent No. 88.12709.

In the implementation illustrated in the drawings, the cable strands define two belts which are identical and mounted in opposition, the said belts being attached at one of their ends to the aforementioned fixing means (24–25) and at their other end to a wind-up reel (27) (35), attached to the rear part of the entablature, after being returned by the rollers (4, 5). Each reel is mounted with the capability of rotation in the two directions in relation to the direction of movement of the carriage. The peripheries of the reels are smooth or possibly channeled, grooved or otherwise treated for for the guiding of the cable strands. In addition, each reel is equipped with a zone for attaching and holding (27.1) the second ends of the cables.

Figure 9:
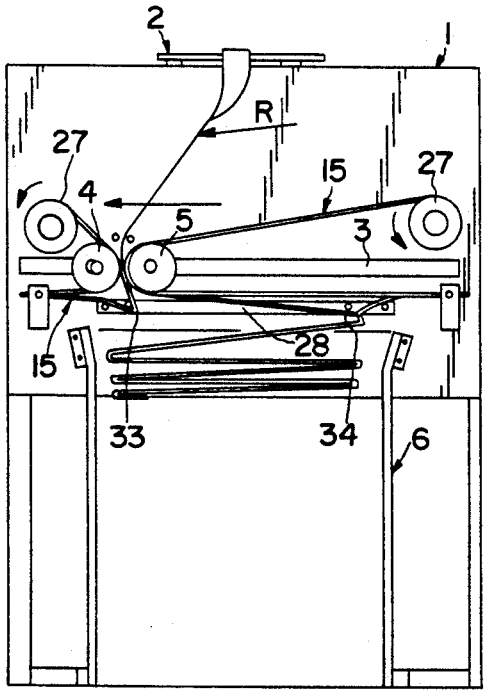
FIGS. 9 and 10 are top views showing the implementation of the packaging of the ribbon or tape using the specific means shown in FIG. 7.
Figure 10:
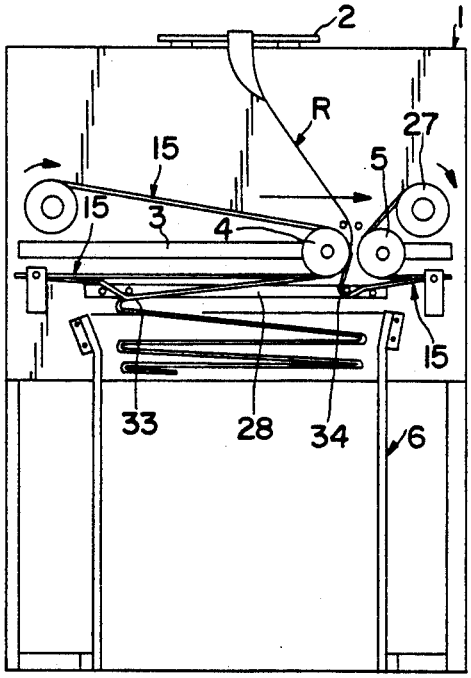

FIGS. 9 and 10 show the operation of the device in the case of using two belts (15) with alternation of state. There is simultaneous winding up of one of the belts and unwinding of the other belt on their respective reels, depending on the position of the carriage.

Thus, in accordance with this first implementation of the invention, one obtains adaptation of the device to the width of the ribbon being processed on the one hand and an adjustable advancement of the folded ribbon or tape parts on the other hand.

This first characteristic also makes it possible to endow the device in accordance with the invention with other advantages by the employment of a supplementary means whose concept is simple but responsive to the problem posed by certain types of tapes or ribbons that have a certain "nervousness", i.e., a tendency to slacken and thus not remain in the desired folded form.

To achieve this, a supplementary means (28) is employed, which is attached to the front part of the entablature in front of the rollers and advantageously in the extension of the fixing blocks (24–25).

More specifically, this means (28) is in the form of a very long bar that is positioned between the aforementioned fixing blocks. This bar, e.g., of square section, is mounted such that it is elevated in relation to the entablature. For example, the bar is engaged by each of its ends on a threaded shaft (29) or similar means attached in an opening (30) provided for this purpose in the entablature. The said bar is supported on a washer (30) against an elastic return means (31) such as a coil spring mounted on each shaft. Locking and clamping means (32) of the nut type are adjusted in position on each shaft, with the capability of adjustment of the height of elevation of the bar in relation to the entablature. The bar is adjusted horizontally. The height of elevation of the bar is established in relation to the width of the folded ribbon or tape so as to allow at the outlet of the rollers (4,5) the introduction of the folded part of the ribbon under the bar and its discharge towards the discharge area. Thus, when the carriage moves laterally along the maximum course established in relation to the length of the folds, the cable strands of the unwinding part of the belt come into support and contact in the same plane of the aforementioned bar or the lower cable strands can be partially engaged under the bar.

In accordance with a valuable original characteristic that can be employed for certain types of ribbons or tapes, the bar is designed to receive a vertical finger (33–34) positioned internally and close to the attachment zone of the bar. The finger established in the form of a shaft traverses the bar and constitutes by its bottom part an interior return means for the cable strands. Thus, these cable strands penetrate more deeply under the bar during the corresponding movement of the carriage, thereby promoting by advances the introduction of the folded ribbon or tape parts. These parts are then maintained by the bearing pressure of the bar and advanced by the cable strands. Thus, when the carriage moves in the opposite direction, the parts of the belt situated under the bar withdraw and the ribbon is always maintained.

In the next cycle, when the new part of the ribbon is introduced under the bar, it induces the advance of the preceding part which thus could not slacken like the phenomenon which was encountered previously. The position of the finger (33–34) on the bar can be adjusted in relation to the width dimensions of the folded ribbons or tapes.

The advantages of the invention have been demonstrated with emphasis on the simplicity of the device, the ease with which it can be assembled and its variability in relation to the characteristics of the ribbons or tapes to be processed. In addition, it is simple to implement, it can be assembled quickly and it is perfectly adaptable to all types of ribbons and tapes.

I claim:

1. A device for zigzag folding of a flexible tape, comprising:

an entablature having means for distributing the tape including a guide for transmitting the tape;

a transverse slot in said entablature;

a pair of rollers disposed within said transverse slot, said rollers having an alternating succession of axially stacked relatively rotatable disks and pulleys, said disks being fixed on said rollers so as to rotate together, each of said pulleys engaging a cable, a plurality of cables constituting a belt for advancing the tape, one end of said cables being anchored in fixing means;

a support carriage beneath said entablature, attachment ends of said rollers attached to said support carriage, said support carriage including motor means for rotating said disks, said rollers rotating in opposite directions whereby the tape is guided between the rollers for folding the tape.

2. The device of claim 1, wherein each disk has a crown constructed of flexible material about its periphery, said disks and crowns defining a generatrix, said pulleys having diameters smaller than the diameter of said disk with said crown, and wherein the cables reside in interior spaces defined by a space between said disks, said rollers allowing passage only of the tape to be folded.

3. The device of claim 1, wherein the rollers are mounted on spindles, said spindles having a base with a lower shoulder, said lower shoulder centering and supporting the disks and pulleys.

4. The device of claim 2, wherein the rollers are mounted on spindles, said spindles having a base with a lower shoulder, said lower shoulder centering and supporting the disks and pulleys.

5. The device of claim 3, wherein the rollers comprise pairs of rings alternately mounted on said spindles, each of said rings having at least one crown made of flexible material and at least one pulley.

6. The device of claim 5, wherein a first ring has multiple staged parts receiving a first crown, a pulley, a second crown and a spacing and support area for a second ring, said second ring having multiple staged parts having a first pulley, a crown and a second pulley, said roller comprised of alternating sequences of first and second rings.

7. The device of claim 1, wherein the fixing means includes an adjustable base for attachment to the entablature, said base having a block with a plurality of channels allowing engagement of said cables, each channel having means operable to grasp, retain and lock each of said cables in position.

8. The device of claim 3, further comprising a washer between each of said disks and pulleys.

9. The device of claim 1, wherein the plurality of cables define two identical belts mounted in opposition, an other end of said cables being attached to winding reels.

10. The device of claim 1, further comprising a bar mounted horizontally over said entablature, said bar having an adjustable elevation, the elevation being determined by a width of the tape to be folded.

11. The device of claim 10, wherein the bar is engaged on a threaded shaft in an opening of the entablature, said bar being supported by elastic return means and locking means for adjustable positioning of the bar.

12. The device of claim 10, wherein the bar has an attachment zone, the bar receiving a vertical finger, said finger being adjustable in position and providing interior return means for said cable to provide improved engagement of said cable under the bar.

* * * * *